United States Patent [19]

Wright

[11] Patent Number: 4,545,900

[45] Date of Patent: Oct. 8, 1985

[54] SPIRAL SEPARATORS

[75] Inventor: Douglas C. Wright, Terranora, Australia

[73] Assignee: Mineral Deposits Ltd., Queensland, Australia

[21] Appl. No.: 422,657

[22] Filed: Sep. 24, 1982

[30] Foreign Application Priority Data

Oct. 9, 1981 [AU] Australia ..... PF1127

[51] Int. Cl.[4] ..... B03B 5/52

[52] U.S. Cl. ..... 209/459; 209/493

[58] Field of Search ..... 209/459, 656, 657, 696, 209/697, 157, 208, 458, 490, 493–494, 506

[56] References Cited

U.S. PATENT DOCUMENTS 4,146,137 3/1979 Beckham ..... 209/696
4,277,330 7/1981 Wright et al. ..... 209/459
4,324,334 4/1982 Wright et al. ..... 209/459

FOREIGN PATENT DOCUMENTS 69436 11/1981 Australia .
1132511 7/1962 Fed. Rep. of Germany .

*Primary Examiner*—David A. Scherbel
*Assistant Examiner*—Glenn B. Foster
*Attorney, Agent, or Firm*—Stevens, Davis Miller & Mosher

[57] ABSTRACT

This invention relates to a spiral separator including an upright column which is supportable with its axis substantially vertically. The spiral separator is adapted to receive at an upper end thereof a plurality of helical turns surrounding the upright column wherein intermediate the height of the separator there is provided an increase in the transverse dimensions or diameter of the separator which provides an initial portion of relatively small transverse dimensions or diameter. By this feature debris or particles of high specific gravity tending to travel in an outer part of the separator adjacent an outer wall thereof entrained with the water in the pulp are caused to travel inwardly toward an inner part of the separator for ultimate separation from particles of low specific gravity.

27 Claims, 5 Drawing Figures

SPIRAL SEPARATORS

This invention relates to an improved spiral separator.

My prior spiral separator is described in Australian Patent Specification No. 69436/81 which is particularly suited for the classification of low density particles generally such as the separation of asbestos from crushed rock and more particularly to the washing of fine coal particles from coal ash.

However it has now been found that the spiral separator of my Australian Specification No. 69436/81 that after the pulp has flowed through an initial upper part of the separator (for example 1½ helical turns) there is a tendency for some of the ash particles of relatively high specific gravity to be caught up or entrained with the desired coal particles which are relatively large and of low specific gravity which travel around on the outside part of the spiral separator adjacent the outer wall thereof. The reason why this happens is that the water in the pulp adjacent the outer wall has a tendency to travel outwardly beyond the outer wall because of its turbulent or substantially circular flow pattern. However this tendency is of course restrained by the outer wall of the spiral separator. Because however of this pattern of flow some ash particles are retained in the outer part of the spiral and this of course adversely affects the separation of coal particles from the debris such as coal ash.

It is therefore an object of the invention to provide a spiral separator which alleviates the abovementioned difficulties associated with the prior art.

The invention provides a spiral separator including an upright column supported with its axis substantially vertically which is adapted to receive at an upper end thereof a pulp of water and particles to be separated; said spiral separator also including a plurality of helical turns surrounding said upright column wherein intermediate the height of the separator there is provided an increase in the transverse dimensions or diameter of the separator thereby providing an initial portion of relatively small transverse dimensions or diameter and at least one subsequent portion of relatively larger transverse dimensions or diameter whereby debris or particles of high specific gravity tending to travel in an outer part of the spiral separator adjacent an outer wall thereof entrained with the water in the pulp are caused to travel inwardly toward an inner part of the spiral separator for ultimate separation from particles of low specific gravity.

The said helical trough when viewed in vertical cross section comprising an upwardly facing working surface including an inner part and an outer part;

- the inner part sloping generally downwardly from a radially inner end towards a radially outward direction;
- the outer part sloping generally upwardly from a radially inner end thereof and in a radially outward direction and blending into an upright radially outer wall;
- the inner end of the inner part of the trough working surface being further from the axis, and the other end of the working surface being closer to the axis, at an initial portion of the trough than at a first portion downstream from the initial portion.

As herein used the term "separator radial dimension" means the distance in a radial direction between the spiral axis and the other end of the trough working surface.

Preferably the initial portion of the spiral separator includes a channel in an outer part of the spiral separator which is initially narrow and deep and becomes progressively wider as described in my Australian Patent Specification No. 69436/81.

Suitably the outer wall of the spiral separator is substantially uniform in height.

It is also preferred that the initial portion of the spiral separator is only relatively short and that the subsequent portion is relatively longer. For example in relation to a spiral separator of 7 turns it is preferred that the initial portion extend for 1½ turns.

Instead of only having one subsequent portion there may also be provided a plurality of subsequent portions with a second subsequent portion being of increased transverse dimensions or diameter relative to a first subsequent portion and so on.

The transition between initial portion and subsequent portion of the spiral separator is preferably relatively sudden and may occur instantaneously or within half a turn of the separator. Alternatively the transition may be more gradual occuring within 1–2 turns of the separator.

Preferably the increase in diameter or transverse dimensions is of the order of 10–20% and is more suitably 14–15%. In one example the initial part may have a radius of 287 mm and the subsequent part may have a radius of 327 mm.

Reference may now be made to a preferred embodiment of the invention as shown in the attached drawings wherein.

Figure 1:
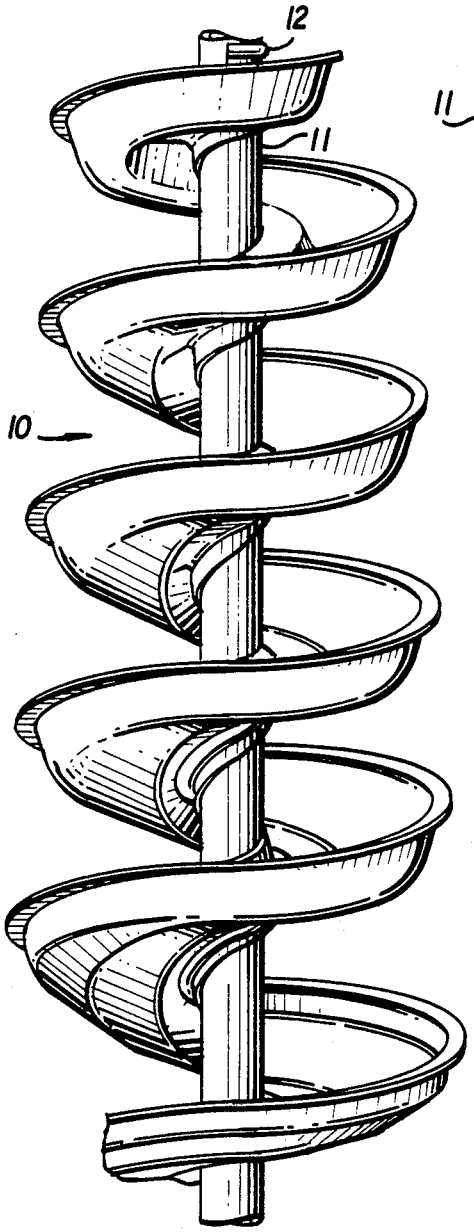
FIG. 1 is a perspective view of a spiral separator constructed in accordance with the invention.
Figure 2:
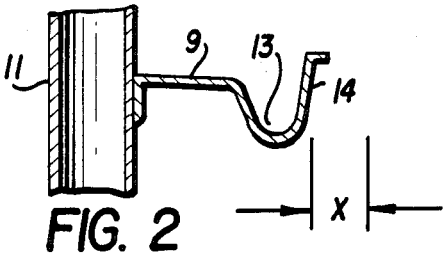
FIG. 2 is a vertical cross sectional view of the initial portion of the spiral separator of FIG. 1 during the initial 1½ turns thereof.
Figure 3:
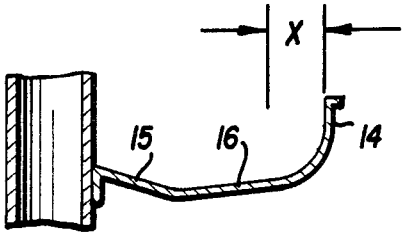
FIG. 3 is a vertical cross sectional view of the spiral separator shown in FIG. 1 after 3 turns thereof showing the transition of initial portion to subsequent portion.

In the drawings there is shown spiral separator 10 having central tubular column 11 and feed pipe 12 through which pulp is passed into the top of the separator 10. Separator 10 is provided with an initial portion shown in FIG. 2 including narrow and deep channel 13 and shelf 9. The initial portion may extend for 1½ turns of separator 10 whereupon thereafter the diameter is increased by a distance x as shown in FIG. 3 to form the above described subsequent portion comprising inner part 15 and outer part 16 located adjacent outer wall 14.

The inner part 15 and outer part 16 constitute the trough working surface, outer part 16 at its outer and blending into outer wall 14.

Figure 4:
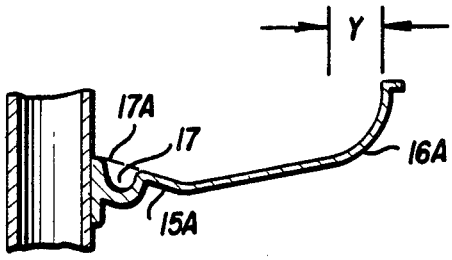
FIG. 4 is a vertical cross sectional view of the spiral separator shown in FIG. 1 after 4–5 turns.

In FIG. 4 there may be provided inner recess or trough 17 or shelf 17A shown in dotted outline and inner part 15A and outer part 16A. A similar profile is shown in FIG. 5.

It has been found that the formation of the subsequent portion by increase in x of the diameter of the separator has greatly facilitated the separation of coal ash from coal particles as the coal ash is maintained in inner part 15 or 15A without having a tendency to have a lateral shift to outer part 16 or 16A.

Figure 5:
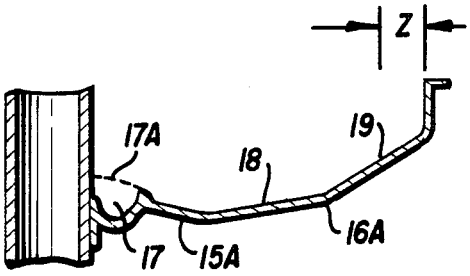
FIG. 5 is a vertical cross sectional view of the spiral separator shown in FIG. 1 after 6 turns.

Preferably outer part 16 or 16A is formed in an inner component 18 having an angle to horizontal of 6° and an outer component 19 having an angle to horizontal of 12° as shown in FIG. 5.

The drawings also show that there may be a plurality of subsequent portions of increased transverse dimensions which are increased by a distance y and a distance z as shown. Suitably the distances x, y and z may be substantially equal but this is not essential. The provision of further portions measured by distances y and z provide further control on the separation of debris or particles of high specific gravity from particles of low specific gravity. Thus if y and z are both 40 mm the subsequent portion indicated by y and shown in FIG. 4 may have a radius of 367 mm and the subsequent portion indicated by z and shown in FIG. 5 may have a radius of 407 mm.

It will also be appreciated that the term "helical turns" as used herein refers to the single turns of an individual spiral separator of helical shape.

I claim:

1. A spiral separator having at least a portion comprising a helical trough supported with its axis upright and including a plurality of turns for separating a pulp of water and minerals flowing theredown;

said helical trough when viewed in vertical cross section comprising an upwardly facing surface including a radially inner part and a radially outer part;

the inner part sloping generally downwardly from a radially inner end towards a radially outward direction;

the outer part sloping generally upwardly from a radially inner end thereof and in a radially outward direction and blending into an upright radially outer wall with a transition between said inner part and the inner end of said outer part;

the outer end of the outer part of the trough working surface being closer to the axis, and the transition between said inner and outer parts of the working surface being further from the axis, at an initial portion of the trough than at a first portion downstream from the initial portion.

2. A spiral separator as claimed in claim 1 wherein the initial portion descends a relatively short distance and the first downstream portion descends a substantially longer distance.

3. A spiral separator as claimed in claim 1 or 2 wherein the change in descent between the initial portion and the first downstream portion is relatively sudden or sharp.

4. A spiral separator as claimed in claim 1 or 2 wherein the outer end of the working surface is about 10–20% further from the spiral axis at the first downstream portion than at the initial portion.

5. A spiral separator as claimed in claim 4 wherein the outer end of the working surface is about 14–15% further from the spiral axis at the first downstream portion than at the initial portion.

6. A spiral separator as claimed in claim 1 or claim 2 wherein the initial portion includes a channel in the outer part thereof which is narrow and deep and becomes progressively wider.

7. A spiral separator as claimed in claims 1 or 2 wherein there is provided a second downstream portion subsequent the first downstream portion wherein the outer end of the working surface is at a greater distance from the spiral axis than the first downstream portion.

8. A spiral separator according to claim 1 or claim 2 wherein the inner part of the working surface decreases in dimension in the radial direction as the spiral is descended.

9. A spiral separator as claimed in claim 3 wherein the increase in spiral diameter between the initial portion and the first downstream portion is about 10–20%.

10. A spiral separator as claimed in claim 9 wherein the increase is about 14–15%.

11. A spiral separator as claimed in claim 3 wherein the initial portion includes a channel in an outer part thereof which is narrow and deep and then becomes progressively wider.

12. A spiral separator as claimed in claim 4 wherein the initial portion includes a channel in an outer part thereof which is narrow and deep and then becomes progressively wider.

13. A spiral separator as claimed in claim 5 wherein the initial portion includes a channel in an outer part thereof which is narrow and deep and then becomes progressively wider.

14. A spiral separator as claimed in claim 9 wherein the initial portion includes a channel in an outer part thereof which is narrow and deep and then becomes progressively wider.

15. A spiral separator as claimed in claim 10 wherein the initial portion includes a channel in an outer part thereof which is narrow and deep and then becomes progressively wider.

16. A spiral separator as claimed in claim 3 wherein there is provided a first downstream portion of increased radial dimension relative to the initial portion and a second downstream portion of increased radial dimension relative to the first downstream portion.

17. A spiral separator as claimed in claim 4 wherein there is provided a first downstream portion of increased radial dimension relative to the initial portion and a second downstream portion of increased radial dimension relative to the first downstream portion.

18. A spiral separator as claimed in claim 5 wherein there is provided a first downstream portion of increased radial dimension relative to the initial portion and a second downstream portion of increased radial dimension relative to the first downstream portion.

19. A spiral separator as claimed in claim 6 wherein there is provided a first downstream portion of increased radial dimension relative to the initial portion and a second portion of increased radial dimension relative to the first downstream portion.

20. A spiral separator as claimed in claim 7 wherein there is provided a third downstream portion of increased radial dimension or diameter relative to the second downstream portion of increased radial dimension relative to the first downstream portion of increased radial dimension relative to the initial portion.

21. A spiral separator as claimed in claim 9 wherein there is provided a first downstream portion of increased radial dimension or diameter relative to the initial portion and a second downstream portion of increased radial dimension or diameter relative to the first downstream portion.

22. A spiral separator as claimed in claim 10 wherein there is provided a first downstream portion of increased radial dimension or diameter relative to the initial portion and a second downstream portion of increased radial dimension or diameter relative to the first downstream portion.

23. A spiral separator as claimed in claim 11 wherein there is provided a first downstream portion of increased radial dimension or diameter relative to the initial portion and a second downstream portion of increased radial dimension or diameter relative to the first downstream portion.

24. A spiral separator as claimed in claim 12 wherein there is provided a first downstream portion of increased radial dimension or diameter relative to the initial portion and a second downstream portion of increased radial dimension or diameter relative to the first downstream portion.

25. A spiral separator as claimed in claim 13 wherein there is provided a first downstream portion of increased radial dimension or diameter relative to the initial portion and a second downstream portion of increased radial dimension or diameter relative to the first downstream portion.

26. A spiral separator as claimed in claim 14 wherein there is provided a first downstream portion of increased radial dimension or diameter relative to the initial portion and a second downstream portion of increased radial dimension or diameter relative to the first downstream portion.

27. A spiral separator as claimed in claim 15 wherein there is provided a first downstream portion of increased radial dimension or diameter relative to the initial portion and a second downstream portion of increased radial dimension or diameter relative to the first downstream portion.

* * * * *